US010538358B2

(12) United States Patent
Ichikawa et al.

(10) Patent No.: US 10,538,358 B2
(45) Date of Patent: Jan. 21, 2020

(54) CONTAINER

(71) Applicant: Hosokawa Yoko Co., Ltd., Tokyo (JP)

(72) Inventors: Toru Ichikawa, Tokyo (JP); Hiroyuki Miyoshi, Tokyo (JP); Tomonari Shinohara, Tokyo (JP)

(73) Assignee: Hosokawa Yoko Co., Ltd., Tokyo (JP)

( * ) Notice: Subject to any disclaimer, the term of this patent is extended or adjusted under 35 U.S.C. 154(b) by 143 days.

(21) Appl. No.: 15/303,506

(22) PCT Filed: Feb. 26, 2015

(86) PCT No.: PCT/JP2015/055563

§ 371 (c)(1),
(2) Date: Oct. 11, 2016

(87) PCT Pub. No.: WO2015/159593

PCT Pub. Date: Oct. 22, 2015

(65) Prior Publication Data

US 2017/0029159 A1 Feb. 2, 2017

(30) Foreign Application Priority Data

Apr. 15, 2014 (JP) ..... 2014-083907

(51) Int. Cl.
*B65D 33/02* (2006.01)
*B65D 1/46* (2006.01)
(Continued)

(52) U.S. Cl.
CPC ..... *B65D 1/46* (2013.01); *B65D 1/225* (2013.01); *B65D 33/02* (2013.01); *B65D 43/16* (2013.01); *B65D 43/22* (2013.01); *B65D 85/70* (2013.01)

(58) Field of Classification Search
CPC ..... B65D 39/16; B65D 51/24; B65D 51/242; B65D 1/0292; B65D 23/102;
(Continued)

(56) References Cited

U.S. PATENT DOCUMENTS 5,765,716 A * 6/1998 Cai ..... A47G 23/0216 220/375
6,047,852 A * 4/2000 Evans ..... A47G 23/0216 220/710.5
(Continued)

FOREIGN PATENT DOCUMENTS

JP 1988086056 U 6/1988
JP 06239365 A 3/1994
(Continued)

OTHER PUBLICATIONS

Japanese Office Action issued in Japanese Patent Application No. 2014-083907 dated Dec. 12, 2017 with English translation.

*Primary Examiner* — Jes F Pascua
*Assistant Examiner* — Nina K Attel
(74) *Attorney, Agent, or Firm* — White and Williams LLP

(57) ABSTRACT

A container 1 according to an embodiment includes a body member 2 so formed of a stacked film 10 as to be self-standing and having an upper opening end 2*a* and a frame member 3 that is so provided as to be joined with an outer circumferential surface of the upper opening end 2*a* of the body member 2 and reinforces an edge portion of the upper opening end 2*a* in such a way that a predetermined opening shape of the upper opening end 2*a* is maintained, and the frame member 3 has a container holder 4 that is provided in a position where a finger touches the body member 2 when the body member 2 is held and extends downward from the frame member 3 to a halfway point of the body member 2.

4 Claims, 10 Drawing Sheets

(51) Int. Cl.

| | |
|---|---|
| ***B65D 1/22*** | (2006.01) |
| ***B65D 43/22*** | (2006.01) |
| ***B65D 43/16*** | (2006.01) |
| ***B65D 85/00*** | (2006.01) |

(58) Field of Classification Search

CPC .... B65D 25/2897; B65D 33/02; B65D 1/225; A61J 9/005; A61J 9/0623

USPC ..... 383/34.1, 80, 36, 901, 12, 33, 34, 105; 215/382–384, 11.1, 11.3, 11.6, 900, 395, 215/396, 231, 392; 220/755, 9.4, 758, 220/740, 669, 674, 710.5, 793, 737–739, 220/666; 604/317; 248/95, 99; 229/87.04, 938, 906.1, 918; 294/30, 27.1, 294/31.2, 1.3; 426/110

See application file for complete search history.

(56) References Cited

U.S. PATENT DOCUMENTS

| | | | | |
|---|---|---|---|---|
| 2008/0247679 | A1* | 10/2008 | Dayton ..... | B65D 33/25 383/33 |
| 2010/0183773 | A1 | 7/2010 | Malone et al. | |

FOREIGN PATENT DOCUMENTS

| | | | |
|---|---|---|---|
| JP | 08080980 | A | 3/1996 |
| JP | 3030183 | U | 7/1996 |
| JP | 09110065 | A | 4/1997 |
| JP | 3041340 | | 9/1997 |
| JP | 2000211651 | A | 2/2000 |
| JP | 2000103428 | A | 11/2000 |
| JP | 2013169993 | A | 2/2013 |

* cited by examiner

CONTAINER

CROSS REFERENCE TO RELATED APPLICATIONS

This application is the U.S. national phase of PCT Application No. PCT/JP2015/055563, filed on Feb. 26, 2015, which claims priority to Japanese Patent Application No. 2014-083907, filed on Apr. 15, 2014, the entire disclosures of which are hereby incorporated by reference in their entirety.

TECHNICAL FIELD

The present invention relates to a container, and more particularly to a container for containing powdered milk for infants, powder coffee, coffee beans, powdered supplements, and other contents the preservability of which is regarded as important.

BACKGROUND ART

A metallic can has been primarily used as a container for containing powdered milk for infants, powder coffee, coffee beans, powdered supplements, and other contents the preservability of which is regarded as important. A metallic can is, however, not allowed to reduce the volume thereof after use but remains bulky and therefore has poor disposability.

Patent Literature 1 discloses a bag body formed of a plastic film and so provided with a zipper for opening and closing the bag body that the bag body itself can be used as a container (pouch container). Use of the pouch container allows compression and disposal of the container after use, resulting in improvement in disposability of the container.

CITATION LIST

Patent Literature

Patent Literature 1: Japanese Patent Laid-Open No. 2013-169993

SUMMARY OF INVENTION

Technical Problem

The pouch container is a bag body formed of a plastic film. Therefore, when a large amount of content remains in the container, the shape thereof is maintained by the content, and the container can be readily held with one hand.

However, when the amount of content decreases, the shape of the pouch container gives way and the self-standing ability therefore decreases because the container has low container rigidity, and it is also difficult to readily hold the container.

The present invention has been made on the basis of the technical recognition described above, and an object of the present invention is to provide a container that not only has self-standing ability and can be readily held irrespective of the amount of remaining content although a body section of the container is formed of a stacked film (laminated film) but also readily allows volume reduction after use for excellent disposability.

Solution to Problem

A container according to the present invention is characterized in that the container includes a body member formed of a stacked film and having an upper opening end, and a frame member that is so provided as to be joined with an outer circumferential surface of the upper opening end of the body member and reinforces an edge portion of the upper opening end in such a way that a predetermined opening shape of the upper opening end is maintained, the frame member having a container holder that is provided in a position where a finger touches the body member when the body member is held and extends downward from the frame member to a halfway point of the body member.

In the container described above, the stacked film may have a first heat seal layer that forms an outer circumferential surface of the body member and allows heat sealing, a second heat seal layer that forms an inner circumferential surface of the body member and allows heat sealing, and a base material layer provided between the first heat seal layer and the second heat seal layer.

In the container described above, in a case where the body member has a polygonal columnar shape, the container holder may be provided at a corner of the frame member.

In the container described above, in a case where the body member has a polygonal columnar shape, the container holder may be so provided as to overlap with two side surfaces of the body member that are adjacent to each other.

In the container described above, the container holder may be provided over the entire outer circumference of the body member along the frame member.

In the container described above, the container holder may be formed in a recessed shape extending along a shape of a finger that holds the body member.

The container described above may further include a base frame fitted into the frame member and a lid member having a lid pivotably attached to the base frame.

Advantageous Effect of Invention

The present invention can provide a container that not only has self-standing ability and can be readily held irrespective of the amount of remaining content although a body section of the container is formed of a stacked film but also readily allows volume reduction after use for excellent disposability.

DESCRIPTION OF EMBODIMENT

Figure 1:
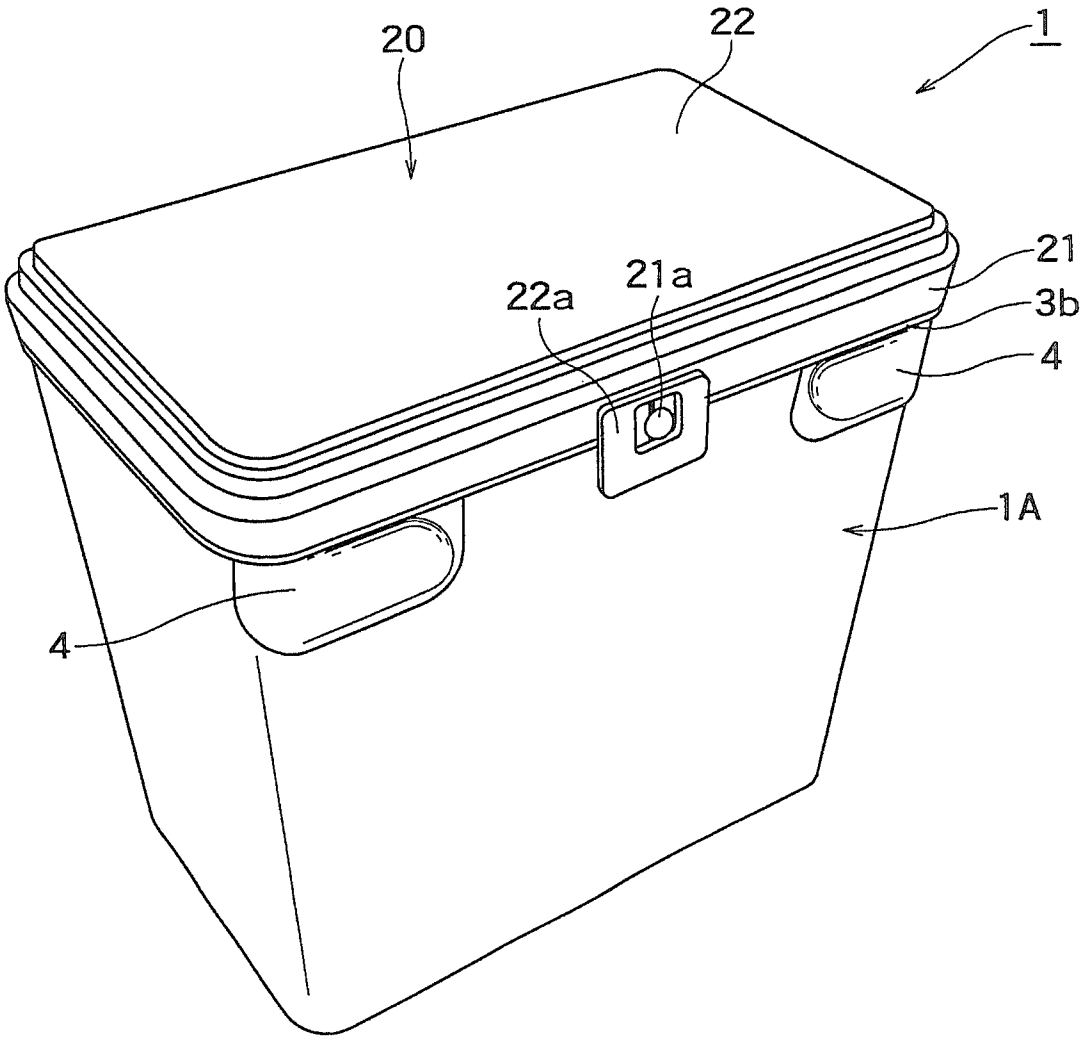
FIG. 1 is a perspective view of a container 1 according to an embodiment of the present invention.

An embodiment according to the present invention will be specifically described below with reference to the drawings. Throughout the drawings, components having an equal function have the same reference character.

An overall configuration of a container 1 according to the embodiment of the present invention will be described with reference to FIGS. 1 and 2. FIG. 1 is a perspective view of the container 1 in a state in which a lid 22 is closed, and FIG. 2 is a perspective view of the container 1 in a state in which the lid 22 is open.

Figure 2:
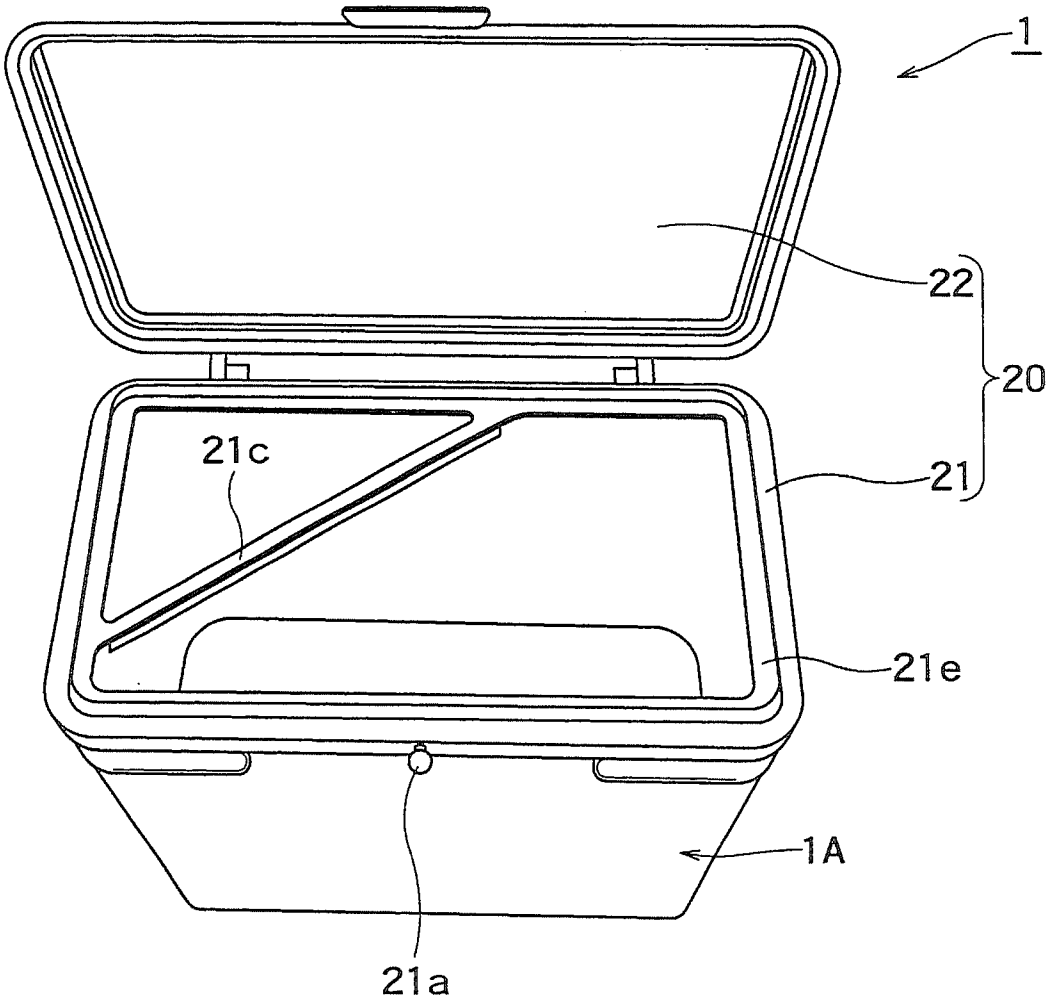
FIG. 2 is a perspective view of the container 1 according to the embodiment in a state in which a lid 22 is open.

The container 1 includes a container main body 1A and a lid member 20, which is fit into an upper opening end of the container main body 1A, as shown in FIGS. 1 and 2. The detailed configuration of the container main body 1A will be described later in detail with reference to FIGS. 3 to 5. The detailed configuration of the lid member 20 will be described later in detail with reference to FIGS. 7 and 8.

The container 1 has a body portion formed of a soft stacked film. The container 1 is, for example, a container for containing powdered milk for infants, powder coffee, powdered supplements, and other types of powdery matter and coffee beans and other particulates. The container 1 may instead be a container for containing soybean paste, jam, and other pasty contents or liquid.

The container 1 has a roughly box-like shape (roughly quadrilateral columnar shape), as shown in FIGS. 1 and 2. The shape of the container 1 is not limited to a box-like shape and may instead, for example, be a circular columnar shape or a roughly polygonal columnar shape other than a quadrilateral columnar shape.

<Configuration of Container Main Body 1A>

Figure 3:
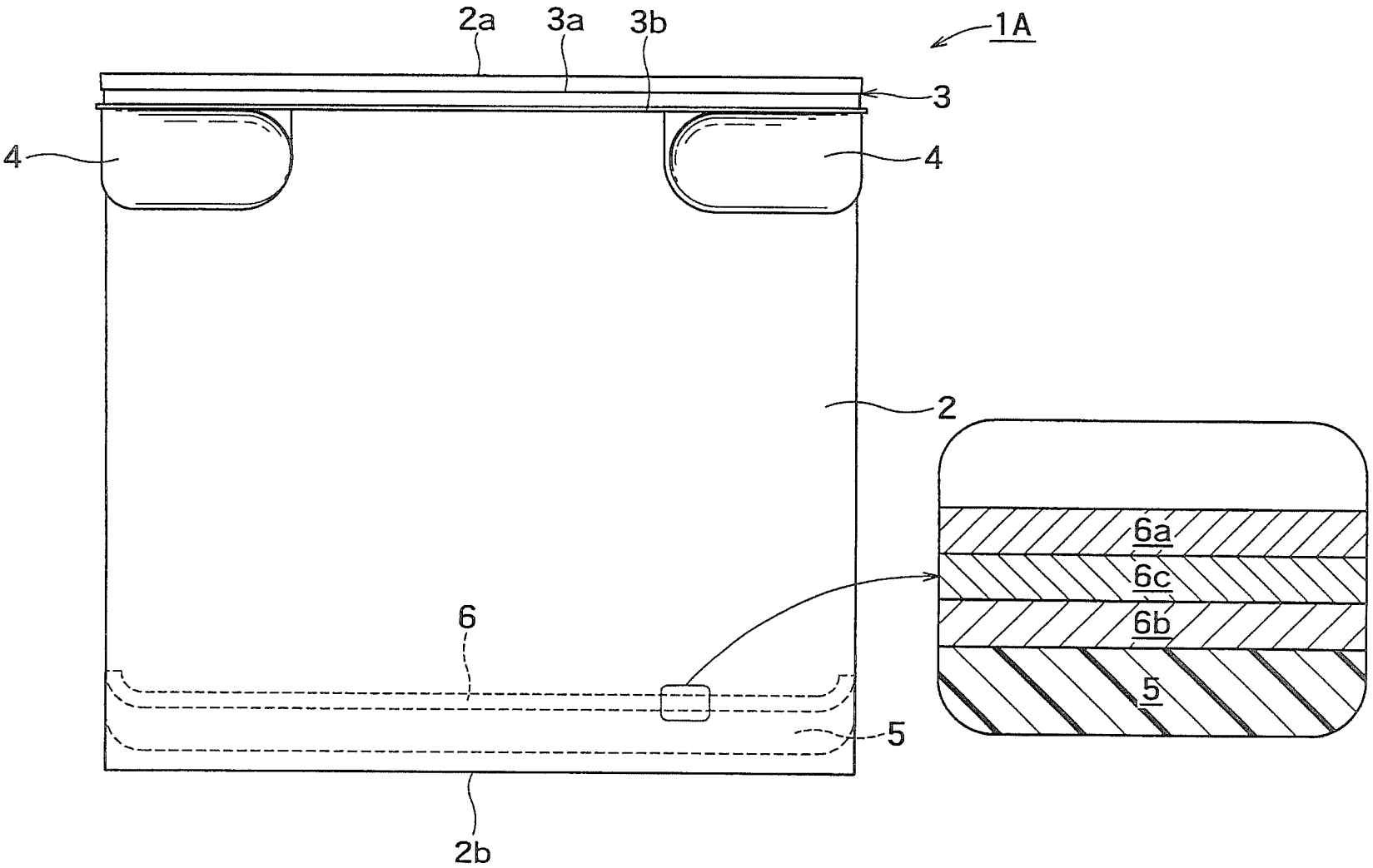
FIG. 3 is a side view of a container main body 1A of the container 1 according to the embodiment.
Figure 4:
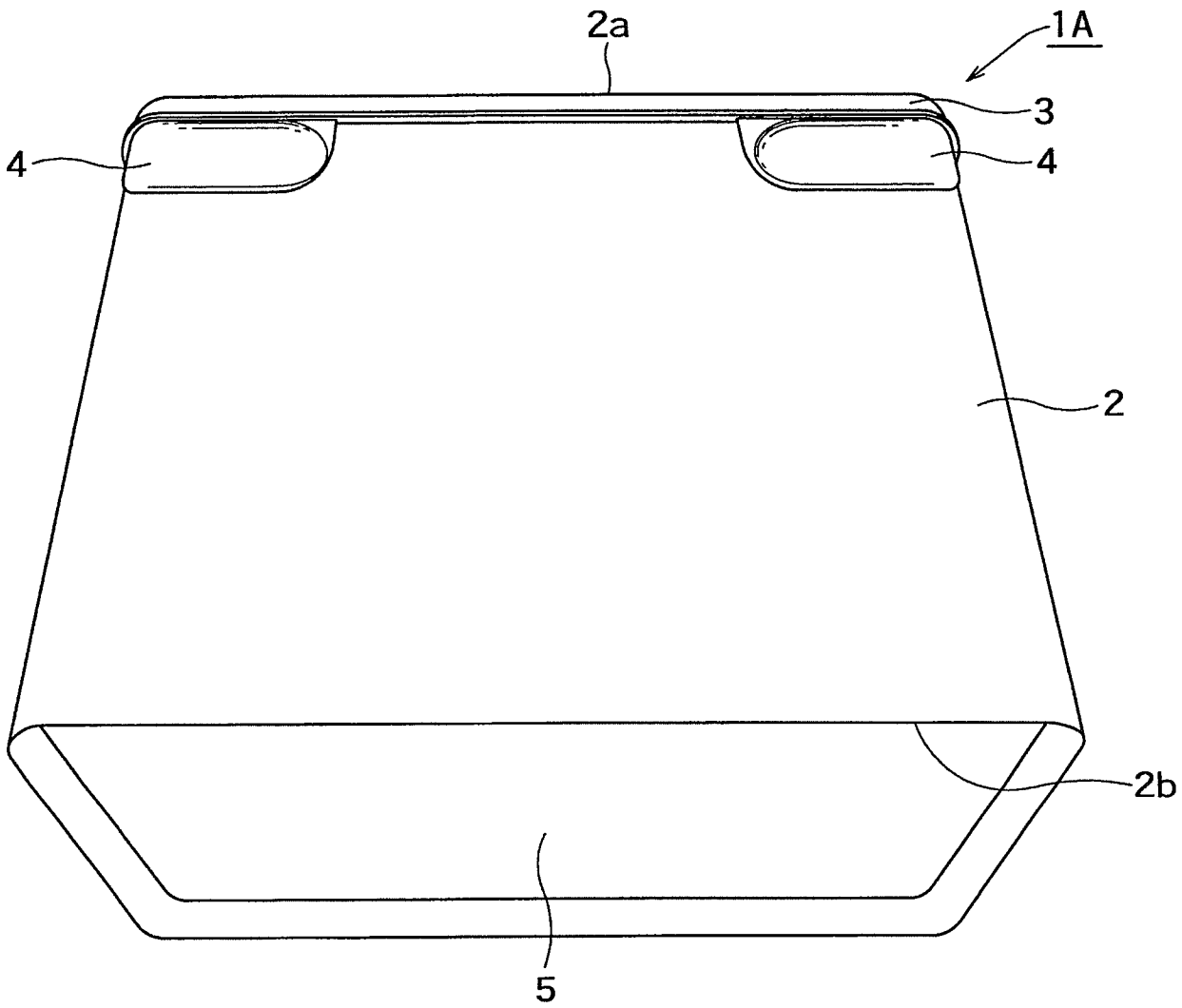
FIG. 4 shows the container main body 1A viewed from obliquely below.
Figure 5:
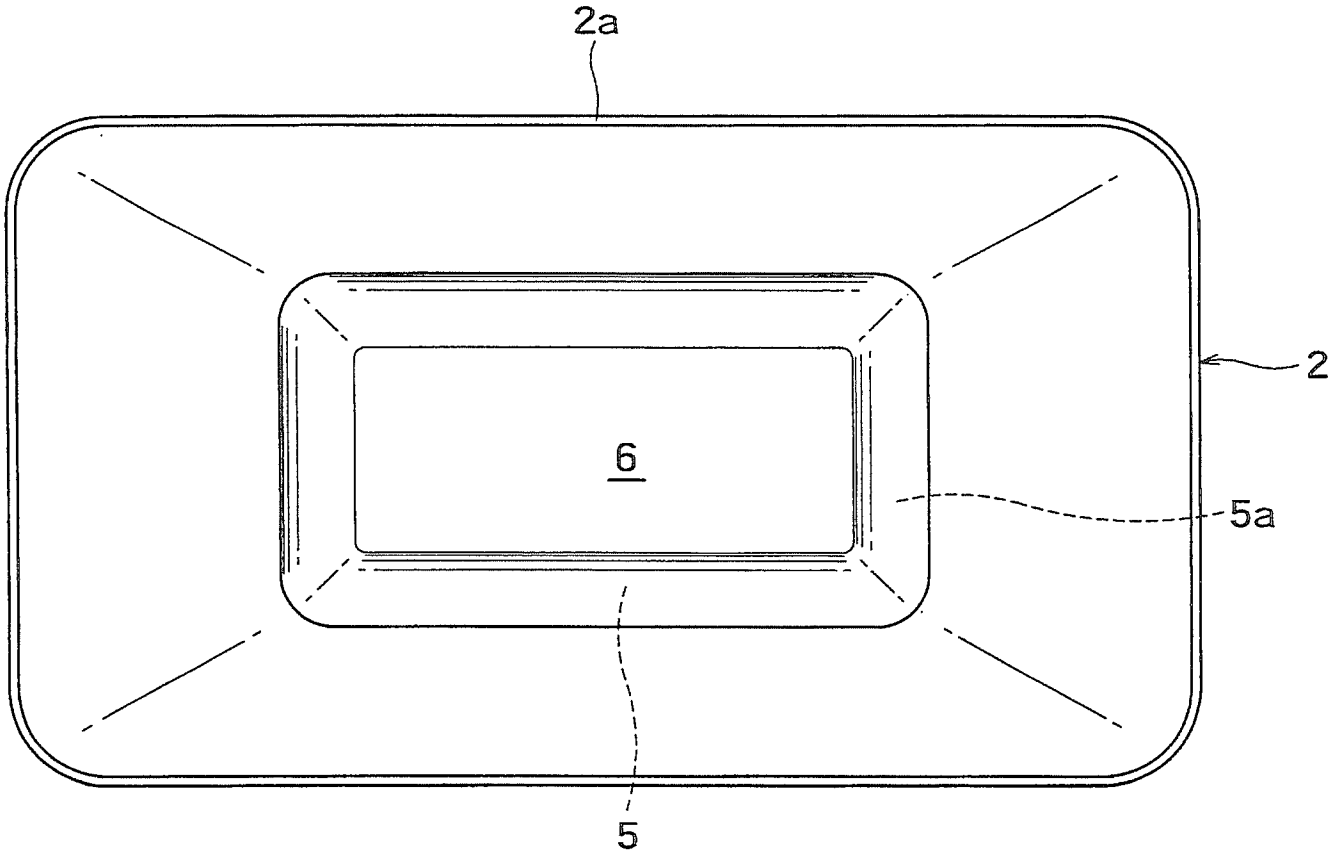
FIG. 5 shows the container main body 1A viewed from above.

The container main body 1A will next be described with reference to FIGS. 3 to 5. FIG. 3 is a side view of the container main body 1A. FIG. 4 shows the container main body 1A viewed from obliquely below. FIG. 5 shows the container main body 1A viewed from above. It is noted that no frame member 3 or container holder 4 is shown in FIG. 5.

The container main body 1A includes a body member 2, a frame member 3, which is provided at the upper end of the body member 2, and a bottom member 5, which is provided at the lower end of the body member 2, as shown in FIGS. 3 and 4. The upper end of the container main body 1A is open, and the lower end thereof is closed with the bottom member 5, as shown in FIG. 5.

The body member 2 is a tubular body having an upper opening end 2*a* and a bottom opening end 2*b*, as shown in FIGS. 3 to 5. As will be described later in the description of a method for manufacturing the container main body 1A, the body member 2 is formed, for example, by seaming end portions of a rectangular stacked film (laminated film) 10 to each other in the shape of an envelope.

Further, the body member 2 is so formed of the stacked film 10 as to be self-standing. The term "self-standing" used herein means that the body member 2 is formed by using the stacked film 10 in the shape of a tube or a bag so that the body member 2 does not undergo bucking deformation due to its own weight.

Figure 6:
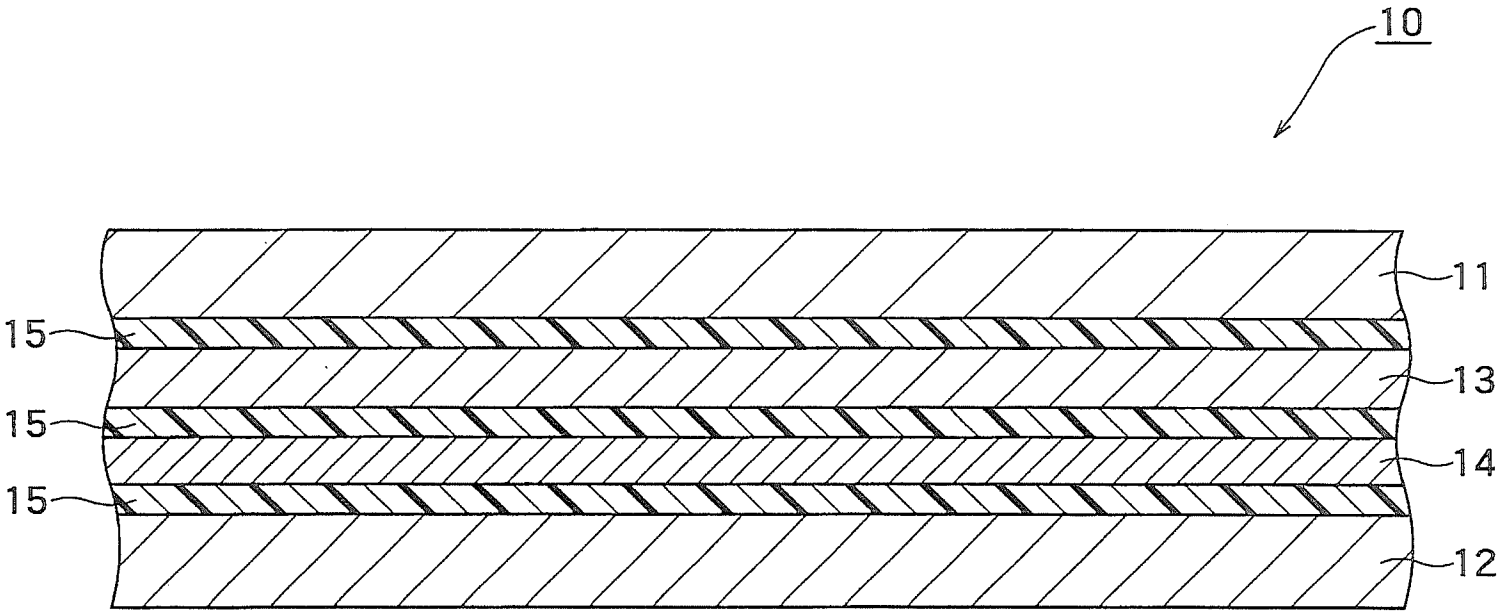
FIG. 6 is a cross-sectional view of a stacked film 10, which forms a body member 2.

The configuration of the stacked film 10, which forms the body member 2, will be described in detail with reference to FIG. 6. FIG. 6 is a cross-sectional view of the stacked film 10.

The stacked film 10 has a heat seal layer 11, which forms the outer circumferential surface of the body member 2, a base material layer 13, which provides the stacked film 10 with predetermined strength, a heat seal layer 12, which forms the inner circumferential surface of the body member 2, and a function layer 14, which is provided between the heat seal layer 12 and the base material layer 13 and provides the stacked film 10 with a predetermined function (gas barrier property or tear property, for example), as shown in FIG. 6. The layers are glued to each other with an adhesive layer 15.

The function layer 14 may be omitted, and the remaining three layers, that is, the heat seal layer 11, the heat seal layer 12, and the base material layer 13, may form the stacked film 10.

Each of the heat seal layers 11 and 12 is a layer that allows heat sealing. Therefore, the heat seal layer 11 is glued to the frame member 3 and container holders 4, and the heat seal layer 12 is glued to the bottom member 5.

Each of the heat seal layers 11 and 12 is made, for example, of low-density polyethylene (LDPE), medium-density polyethylene (MDPE), high-density polyethylene (HDPE), linear low-density polyethylene (L-LDPE), or polypropylene (PP). Each of the heat seal layers 11 and 12 is preferably an unstretched film made of any of the materials described above. Instead, each of the heat seal layers 11 and 12 is preferably a multilayer film made of a combination of any of the resin materials described above and formed by co-extrusion.

Each of the heat seal layers 11 and 12 has a thickness ranging preferably from 10 to 200 μm, more preferably from 20 to 150 μm.

The base material layer 13 is provided between the heat seal layer 11 and the heat seal layer 12 and preferably has not only excellent printability but also thrust strength, tensile strength, impact resistance, and other advantageous properties.

The base material layer 13 is made, for example, of a polyethylene terephthalate (PET), polypropylene (PP), nylon (NY), or an ethylene/vinyl alcohol copolymer (EVOH).

The base material layer 13 may be a stretched or unstretched film made of any of the materials described above.

The base material layer 13 may instead be a vapor deposited film that is a film on which aluminum, magnesium, or any other a metal or a silicon oxide or any other oxide is deposited. Still instead, the base material layer 13 may be a coated film that is a film on which a barrier coating agent, such as polyvinylidene chloride, is coated. The thus configured base material layer 13 is allowed to have a gas barrier property.

The base material layer 13 may be a vapor deposited film or a coated film alone or a multilayer film made of a combination of a plurality of resins and formed by co-extrusion.

The base material layer 13 has a thickness ranging preferably from 6 to 50 μm, more preferably from 9 to 30 μm.

The function layer 14 is formed of what is called a functional film. The function layer 14 is, for example, a metal foil made, for example, of aluminum, magnesium, iron, or copper.

The function layer 14 may instead be a plastic film that improves an anti-pinhole property or a vapor deposited film (such as vapor deposited film that is biaxially-oriented film on which metal or metal oxide is deposited). Still instead, the function layer 14 may be a barrier film made, for example, of an ethylene/vinyl alcohol copolymer or a coated film the surfaces of which are coated with a barrier coating agent.

The function layer 14 may be formed of one layer or two or more layers.

The function layer 14 has a thickness ranging preferably from 5 to 50 μm, more preferably from 6 to 40 μm.

The body member 2 is not necessarily formed by seaming or otherwise processing a single stacked film 10 in the form of a tubular envelope. For example, the body member 2 may be formed by heat-sealing rear surfaces (inner surfaces) of right and left end portions of a single rectangular stacked film to each other and folding the resultant butt seamed portion toward the body member into a tubular shape or heat-sealing opposing edge portions of two rectangular stacked films into a tubular shape. Still instead, the body member 2 may be a bag body formed by heat-sealing a half-folded bottom member to the bottom opening end of the tubular body member 2, as in the case of a bottom gusset bag (standing pouch).

The bottom member 5, which closes the bottom opening end 2*b* of the body member 2, will next be described in detail.

The bottom member 5 is so formed as to be joined with the inner circumferential surface of the lower end of the body member 2 so that the bottom member 5 closes the bottom opening end 2*b* of the body member 2, as shown in FIG. 4. The bottom member 5 closes the bottom opening end 2*b* of the body member 2 in an airtight or liquid-tight manner in accordance with the type of the content (powdery matter, pasty substance, and liquid) in the container 1.

The material of the bottom member 5 is, for example, low-density polyethylene, medium-density polyethylene, high-density polyethylene, linear low-density polyethylene, or polypropylene.

An edge portion 5*a* of the bottom member 5 is rounded, as shown in FIG. 5. As a result, the content is unlikely to be left at the bottom corners of the container 1, whereby the content in the container 1 can be taken out with no leftover.

The container main body 1A may further include a bottom stacked film (laminated film) 6 so heat-sealed to the bottom member 5 as to coat the bottom member 5 exposed to the bottom interior of the container main body 1A, as shown in FIG. 5.

The bottom stacked film 6, for example, has an inner film 6*a*, which faces the interior of the container, an outer film 6*b*, which is glued to the bottom member 5, and a base material layer 6*c*, which is sandwiched between the inner film 6*a* and the outer film 6*b*. The base material layer 6*c*, the outer film 6*b*, and the inner film 6*a* can be made of materials similar to those of the base material layer 13, the heat seal layer 11, and the heat seal layer 12 of the stacked film 10, respectively.

The outer film 6*a* is desirably made of a material of the same type as the type of the material of the bottom member 5. As a result, when the bottom stacked film 6 is heat-sealed to the bottom member 5, the bottom stacked film 6 can be more securely in intimate contact with the bottom member 5.

The outer film 6*b* is required to be heat sealable, but the inner film 6*a* is not necessarily heat sealable.

The bottom stacked film 6 may not include the inner film 6*a* and may have a two-layer configuration formed of the base material layer 6*c* and the outer film 6*b*.

The configuration of the bottom stacked film 6 may be the same as that of the stacked film 10. In this case, a function layer similar to the function layer 14 may be provided as required between one of the heat seal layers and the base material layer.

In a case where desire characteristics (such as barrier performance) are ensured, the bottom stacked film 6 does not need to completely coat the bottom member 5 exposed to the interior of the container. That is, the bottom member 5 may be exposed through the space between the inner circumferential surface of the body member 2 and the bottom stacked film 6.

On the other hand, in a case where airtightness or liquid tightness is required, the entire bottom member 5 exposed to the interior of the container may be coated with the bottom stacked film 6. That is, the body member 2 and the bottom member 5 may be glued to each other via a bottom stacked film 6 so formed in a drawing process in advance as to have the same shape of the bottom member 5. A specific manufacturing method in this case is, for example, as follows:

First, the bottom stacked film 6 is so formed in a drawing process as to have the same shape of the bottom member 5. A film having heat sealable surfaces on both sides (inner and outer sides) is used as the bottom stacked film 6.

The bottom stacked film 6 formed in the drawing process is then positioned at the bottom opening end 2*b* of the body member 2 placed in a die.

The bottom member 6 is then formed in insert injection molding. In this process, the bottom stacked film 6 is heat-sealed to the body member 2 by use of heat of the molded resin.

The frame member 3 formed at the upper opening end 2*a* of the body member 2 will next be described.

The frame member 3 is so provided as to be joined with the outer circumferential surface of the upper opening end 2*a* of the body member 2, as shown in FIG. 3. The frame member 3 reinforces an edge portion of the upper opening end 2*a* in such a way that the upper opening end 2*a* keeps having a predetermined opening shape (such as rectangular shape, polygonal shape, and circular shape).

A fitting section 3*a* and a flange section 3*b* are provided along the side surface of the frame member 3, as shown in FIG. 3. The fitting section 3*a* is fit into a groove section 21*d* of a base frame 21, which will be described later, when the lid member 20 is attached to the container main body 1A. Each of the fitting section 3*a* and the groove section 21*d* has a stepped portion, and the stepped portions allow the fitting section 3*a* and the groove section 21*d* to engage with each other.

The material of the frame member 3 is, for example, low-density polyethylene, medium-density polyethylene, high-density polyethylene, linear low-density polyethylene, or polypropylene.

The container holders 4, with which the frame member 3 is provided, will next be described.

Each of the container holders 4 extends from the frame member 3 downward (toward bottom) to a halfway point of the body member 2. Specifically, each of the container holders 4 extends from the flange section 3*b* of the frame member 3 toward the bottom of the container main body 1A, as shown in FIG. 3.

In one non-limiting example, each of the container holders 4 may have a roughly oblong shape, such as shown in plan view in FIG. 3. As shown in FIG. 3, container holders 4 may have a length that is greater than their width, where width is measured in a direction from the upper opening end 2*a* of the body member 2 to the bottom of the body member 2. In other examples, container holders 4 may have an elliptical shape or any other shape.

The container holders 4 are provided in positions where fingers touch the body member 2 when the body member 2 is held with the fingers. The container 1 can thus be readily held.

For example, the container holders 4 are provided in portions where fingers are put when the container 1 is grabbed with one hand. In the case where the container 1 has a roughly box-like shape, it is preferable to provide at least two container holders 4 at corners of the frame member 3 that are adjacent to each other. More preferably, the container holders 4 are provided at the corners at the opposite ends of a short side of the frame member 3 having an oblong shape. The container holder 4 may instead be provided at each of the four corners of the frame member 3.

Also in a case where the body member 2 has a roughly triangular columnar shape, it is preferable to provide the container holders 4 at corners adjacent to each other. In a case where the body member 2 has a roughly pentagonal columnar shape, it is preferable to provide the container holders 4 at the corners located on both sides of a predetermined corner of the frame member 3.

The material of the container holders 4 is, for example, low-density polyethylene, medium-density polyethylene, high-density polyethylene, linear low-density polyethylene, or polypropylene.

In a case where the body member 2 has a roughly polygonal columnar shape, such as a quadrilateral columnar shape, it is preferable to provide the container holders 4 at corners of the frame member 3, which are relatively rigid, as shown in FIG. 3. As a result, deformation of the container 1 is unlikely to occur when the container is held, whereby the container can be further readily held irrespective of the amount of remaining content.

In a case where the body member 2 has a circular columnar shape, the container holders 4 are provided along the entirety or part of circumference of the circular frame member 3. In the case where the container holders 4 are provided at part of the frame member 3, the container holders 4 are preferably provided at two or more locations so that fingers touch the body member 2 when the body member 2 is held with one hand.

Each of the container holders 4 is preferably formed in a recessed shape extending along the shape of a finger that holds the body member 2. That is, the surface of the container holder 4 is preferably shaped in accordance with the shape of a finger that holds the container. As a result, the container 1 can be further readily held.

<Configuration of Lid Member 20>

Figure 7:
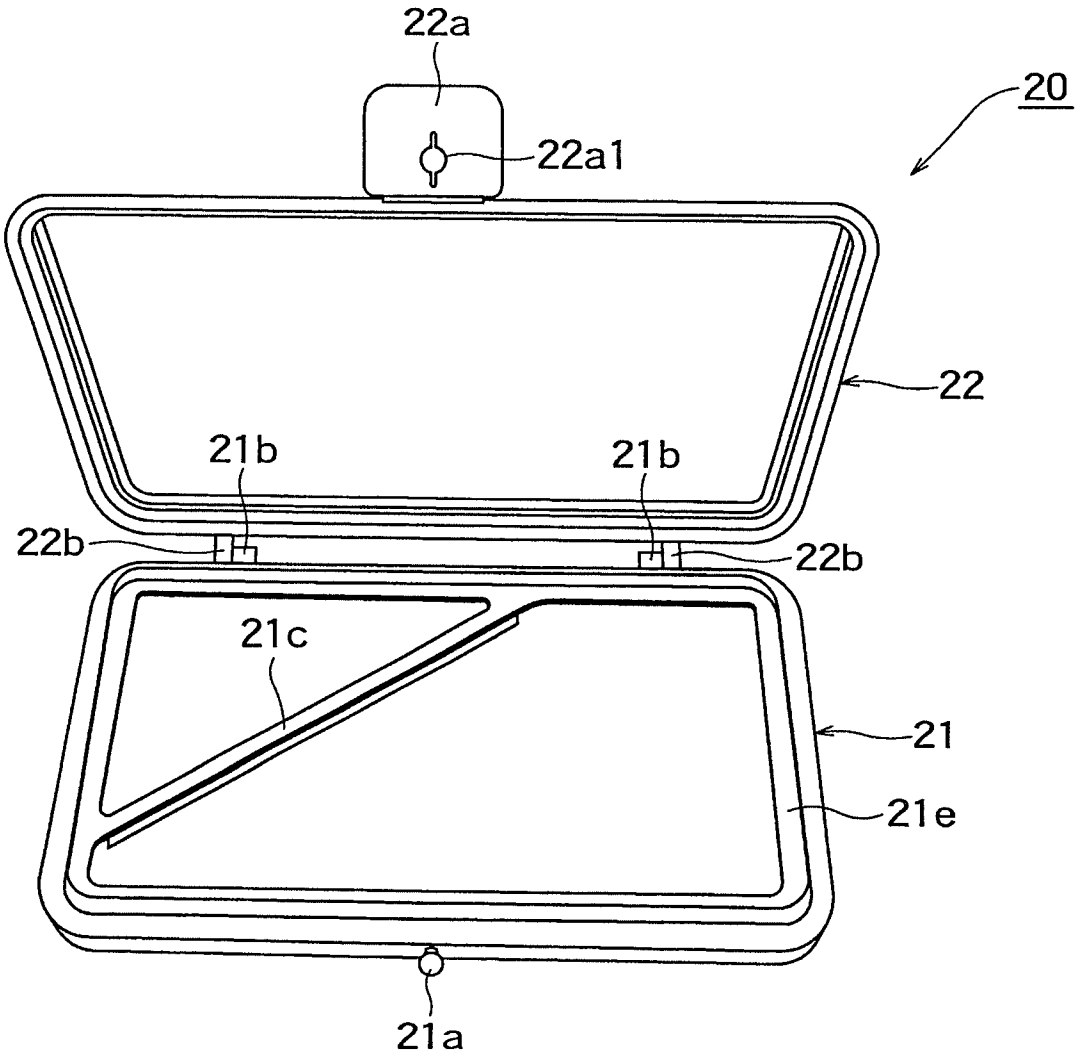
FIG. 7 is a top view of a lid member 20 in the state in which the lid 22 is open.
Figure 8:
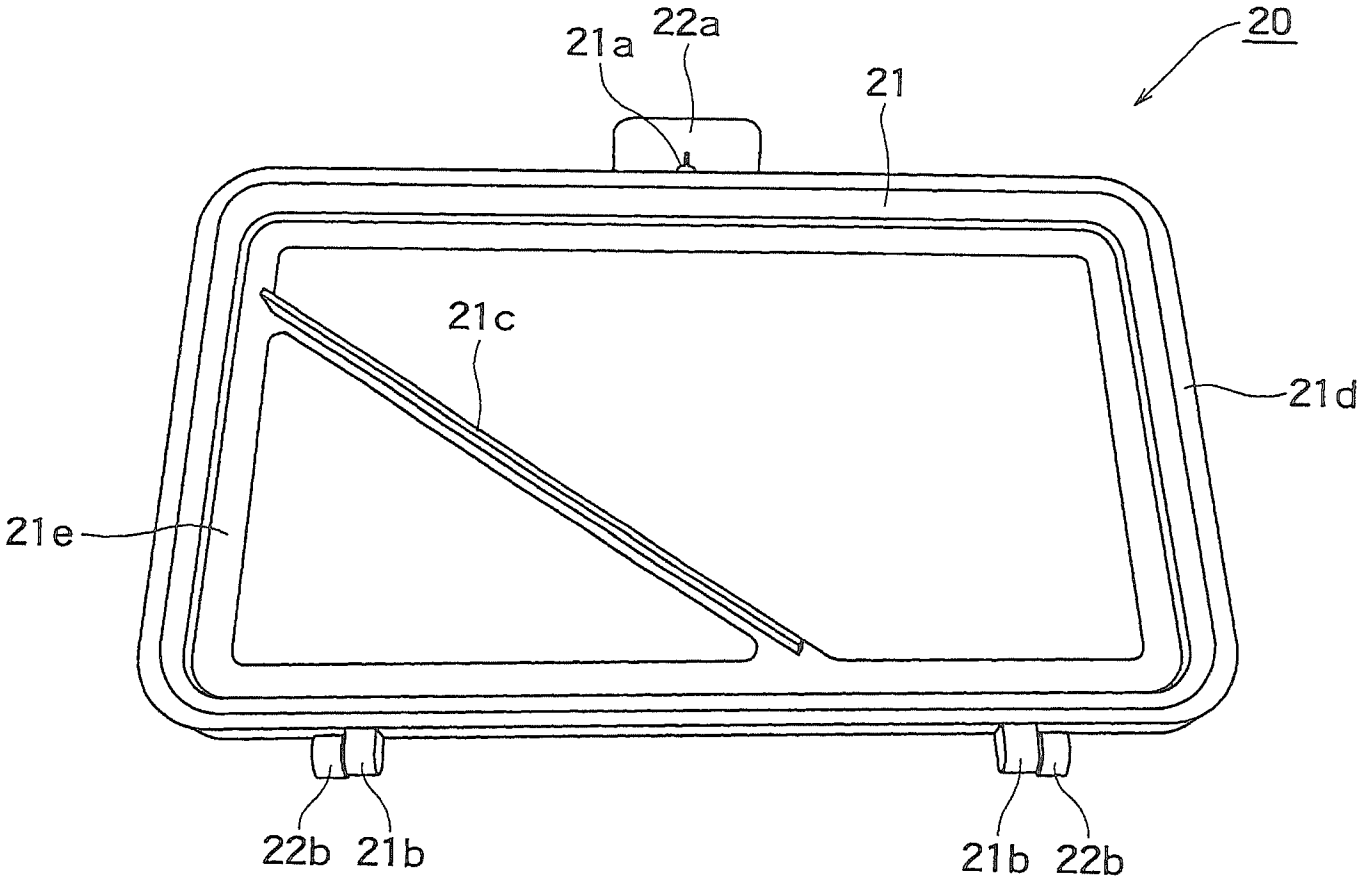
FIG. 8 is a bottom view of the lid member 20 in a state in which the lid 22 is closed.

The configuration of the lid member 20, which is fit into the opening end of the container main body 1A, will next be described in detail with reference to FIGS. 7 and 8. FIG. 7 is a top view of the lid member 20 in a state in which the lid 22 is open, and FIG. 8 is a bottom view of the lid member 20 in a state in which the lid 22 is closed.

The lid member 20 has a base frame 21, which is fit into the frame member 3, and the lid 22, which is pivotably attached to the base frame 2, as shown in FIG. 7.

The base frame 21 has a shape extending along the upper opening end 2*a* of the frame member 3. The groove section 21*d*, which extends along the shape of the base frame 21, is provided in the base frame 21, as shown in FIG. 8. When the opening end of the container main body 1A is inserted into the groove section 21*d*, the lid member 20 is fit into the container main body 1A. The configuration in which the base frame 21 and the frame member 3 are joined with each other allows further reinforcement of the edge portion of the upper opening end 2*a*.

The base frame 21 is provided with connection sections 21*b*, and the lid 22 is provided with connection sections 22*b*. A protrusion of each of the connection sections 21*b* engages with a recess of the corresponding connection section 22*b* to form a hinge. The hinge allows the lid 22 to pivot relative to the base frame 21.

The base frame 21 is provided with a protruding section 21*a*, which convexly protrudes from the outer circumferential surface of the base frame 21. A latch 22*a* is provided at an end of the lid 22. A through hole 22*a*1 is formed in the latch 22*a*, and the protruding section 21*a* engages with the through hole to keep the lid 22 being closed.

The base frame 21 may instead be integrated with the frame member 3 of the container main body 1A. In this case, the lid 20 is attached to the container main body 1A to complete the container 1.

A leveling section 21*c* may be provided in an inner extension section 21*e* of the base frame 21, as shown in FIG. 7. The leveling section 21*c* allows the content in the container 1 to be readily measured by use of a measuring spoon. The levelling section 21*c* may be integrated with the base frame 21 or may be a member molded separately from the base frame 21 and glued to the base frame 21. The shape of the leveling section 21*c* is not limited to a specific shape and may be a plate-like shape, a rod-like shape, or a string-like shape.

The lid member 20 may further be provided with an inner lid (not shown) as required. The inner lid can improve the airtightness of the container 1 or the preservability of the content. The inner lid is, for example, a stacked film peelably attached to the inner extension section 21*e* of the base frame 21. A knob (not shown) may be provided at an end of the inner lid so that the inner lid can be readily peeled off. The inner lid may be provided on the frame member 3 of the container main body 1A instead of the lid member 20.

The inner lid described above is preferably formed of a stacked film having at least a base material layer and a heat seal layer. To allow the inner lid to be readily peeled off, the heat seal layer may be made of an easy peel material. A gas barrier property can ne imparted to the inner lid by using a vapor deposited film as the base material layer or sandwiching a metal foil or a vapor deposited film as a functional layer between the base material layer and the heat seal layer.

A stacked film may be stick onto the inner side of the lid 22 in place of the inner lid. The stacked film, for example, has a three-layer configuration formed of a heat seal layer, a barrier layer, and a heat seal layer. The stacked film may have a configuration similar to that of the stacked film that forms the inner lid.

<Method for Manufacturing Container 1>

A method for manufacturing the container 1 will next be described.

The stacked film 10 is first used to form the body member 2. For example, end portions of the rectangular stacked film 10 are seamed to each other in the shape of an envelope to form the tubular body member 2. In this process, the end portions of the stacked film 10 that are exposed inward (exposed to the content) may be coated with a tape (not shown). In this case, a tape made of the same material of the heat seal layer 12 of the stacked film 10 is heat-sealed to the rear surface of the stacked film 10. The heat-sealed tape prevents direct contact of the content with the end portions of the stacked film 10.

The method for forming the tubular body that forms the body member 2 is not limited to the envelope seaming method and may, for example, be a method for forming a butt seam bag. In this case, the rear surfaces (inner surfaces)

of right and left end portions of the rectangular stacked film 10 are heat-sealed to each other, and the heat-sealed portion is folded to form the tubular body. The tubular body may instead be formed by causing the right and left end portions of the stacked film 10 to face each other and then seaming a tape to the stacked film 10 so as to overlap both the two end portions.

Next, in the case where the bottom stacked film 6 described above is provided, a stacked film is so processed, for example, in a drawing process as to have a predetermine size to prepare the bottom stacked film 6.

The body member 2 formed as described above is then inserted into a mandrel (molding die). A molding space is formed between each predetermined portion of the body member 2 and the mandrel.

The bottom stacked film 6 is then inserted into the body member 2 and positioned on the side facing the bottom opening end 2*b* of the body member 2.

The frame member 3 and the container holders 4 are formed at the upper opening end 2*a* of the body member 2 and the bottom member 5 is formed at the bottom opening end 2*b* in an insert injection molding, in which a melted resin is injected into the molding spaces. The container main body 1A is thus manufactured. The bottom member 5 formed of a resin molded body allows a container that excels in self-standing ability to be manufactured irrespective of the amount of remaining content.

The lid member 20 is then attached to the container main body 1A. In more detail, the fitting section 3*a* of the frame member 3 on the container main body 1A is inserted into the groove section 21*d* of the base frame 21 of the lid member 20. The engagement between the fitting section 3*a* and the groove section 21*d* fixes the lid member 20 to the container main body 1A in such a way that the lid member 20 cannot be or is hardly separate from the container main body 1A.

The container 1 is manufactured after the steps described above are carried out.

The frame member 3, the container holders 4, and the bottom member 5 are not necessarily formed in the insert injection molding, and members molded in advance may be glued to the body member 2.

The bottom member 5 may instead be formed by heat-sealing a stacked film to the body member 2, as in the case of a standing pouch.

Figure 9A:
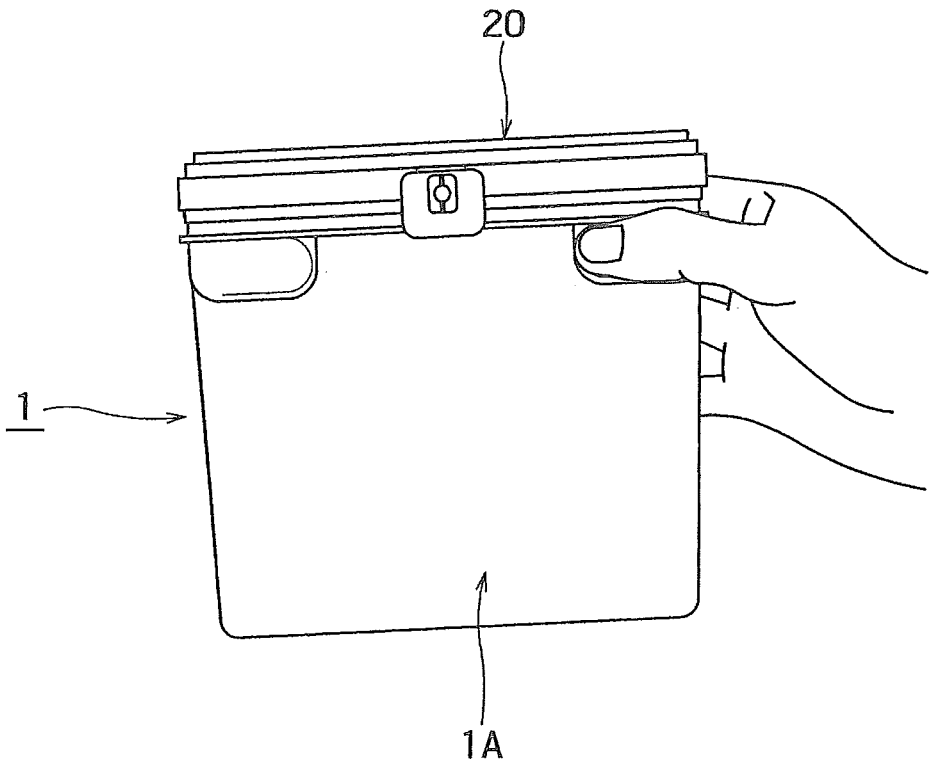
FIG. 9A shows a state in which the container 1 is held with one hand.
Figure 9B:
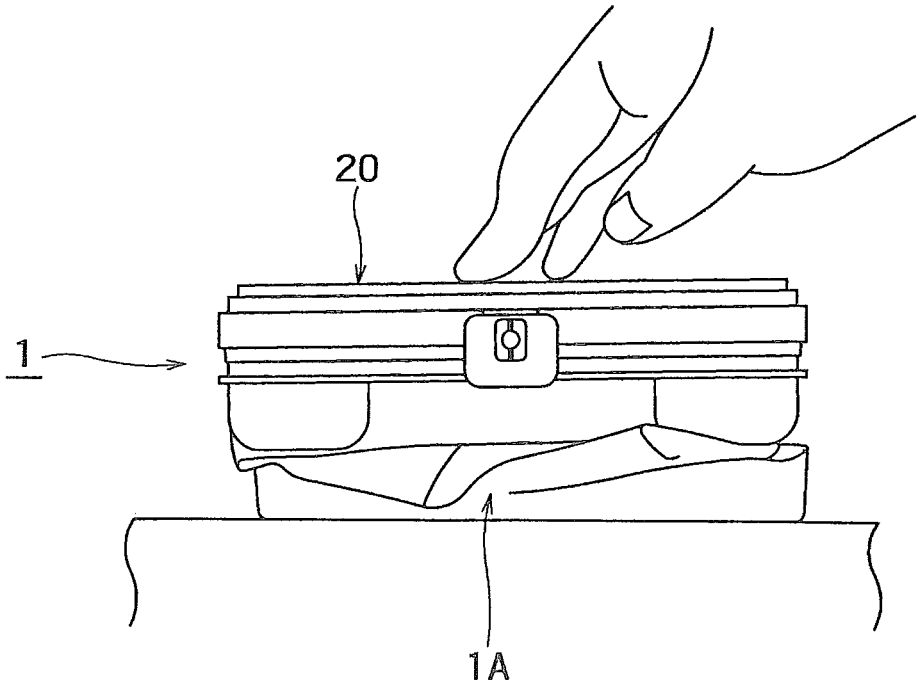
FIG. 9B shows a state in which the container 1 is so compressed in the height direction thereof for volume reduction.

FIG. 9A shows a state in which the container 1 is held with one hand, and FIG. 9B shows a state in which the container 1 is so compressed in the height direction thereof for volume reduction.

Use of the container holders 4 allows the container 1 to be readily held with one hand, as shown in FIG. 9A.

Further, since the portion of the container 1 between the container holders 4 and the bottom member 5 is formed of the stacked film 10, the body member 2 undergoes buckling deformation when the container 1 is compressed in the height direction thereof after use, and the volume of the container 1 is reduced, as shown in FIG. 9B. As described above, the volume of the container 1 can be greatly reduced after use.

Figure 10A:
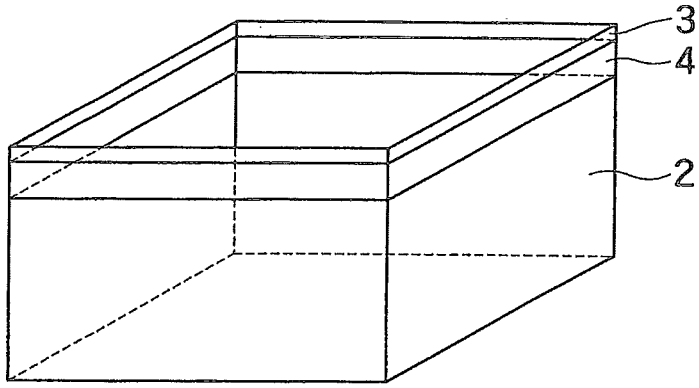
FIGS. 10A to 10D show container holders 4 according to other embodiments.
Figure 10B:
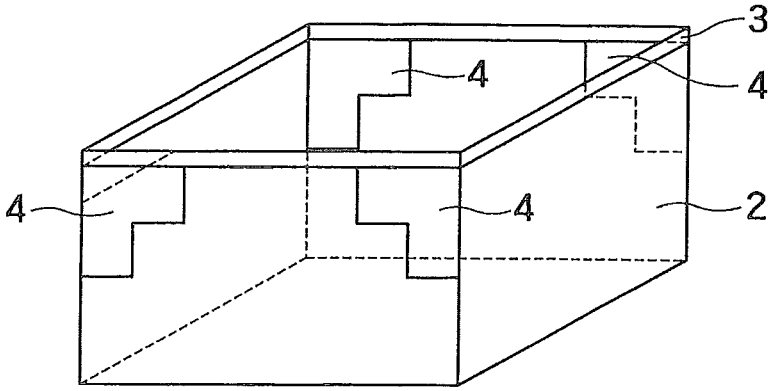
Figure 10C:
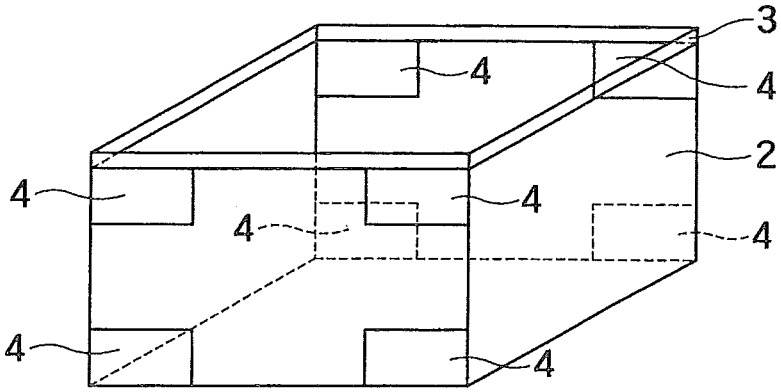
Figure 10D:
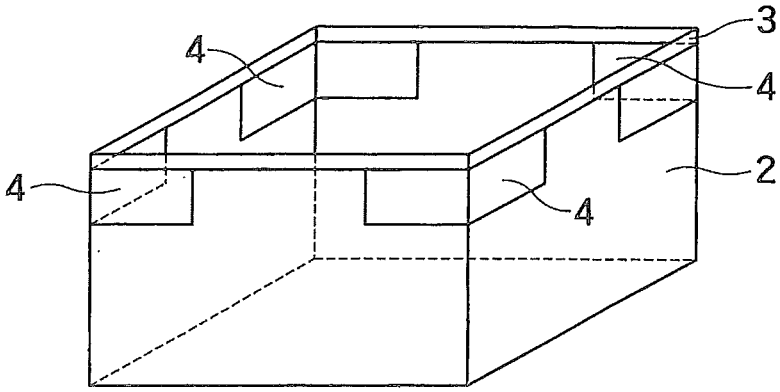

Each of the container holders 4 does not necessarily have the shape shown in FIG. 3 and other figures, and a variety of other embodiments are conceivable. FIGS. 10A to 10D show other embodiments of the container holders 4. In FIG. 10A, a single container holder 4 is provided over the entire outer circumference of the body member 2 along the frame member 3. In FIG. 10B, each of the container holders 4 extends from the frame member 3 toward the bottom of the container and is so provided that the width of the container holder 4 narrows from a halfway point thereof. In FIG. 10C, the container holders 4 are also provided in the vicinity of the lower end of the container. In FIG. 10D, one container holder 4 is so provided as to overlap with two side surfaces of the body member 2 that are adjacent to each other. According to the examples described above, the container can be held in a further readily manner.

As described above, in the container 1 according to the present embodiment, the container holders 4 are provided in positions where fingers touch the body member 2 when the body member 2 is held. Further, the frame member 3, which reinforces the edge portion of the upper opening end 2*a* of the body member 2, suppresses deformation of the container when the container is held via the container holders 4. As a result, the container 1 can be readily held without collapse of the container 1 irrespective of the amount of remaining content.

Further, the body member 2 is formed of the stacked film 10, and each of the container holders 4 is so provided as to extend from the frame member 3 toward the bottom of the container to a halfway point of the body member 2. As a result, the portion where no container holder 4 is provided can be readily compressed and deformed after no content is left.

The present embodiment can therefore provide a container that can be readily held irrespective of the amount of remaining content and readily allows volume reduction after use for excellent disposability.

A person skilled in the art may conceive of additional effects of the present invention and a variety of changes thereto on the basis of the above description, but aspects of the present invention are not limited to the embodiments described above. A variety of additions, changes, and partial omissions are possible to the extent that they do not depart from the conceptual idea and sprit of the present invention that are derived from the contents set forth in the claims and equivalents of the contents.

REFERENCE SIGNS LIST

1 Container
1A Container main body
2 Body member
2*a* Upper opening end
2*b* Bottom opening end
3 Frame member
3*a* Fitting section
3*b* Flange section
4 Container holder
5 Bottom member
5*a* Edge portion
6 Bottom stacked film
6*a* Inner film
6*b* Outer film
6*c* Base material layer
10 Stacked film
11,12 Heat seal layer
13 Base material layer
14 Functional layer
15 Adhesive layer
20 Lid member
21 Base frame
21*a* Protruding section
21*b* connection section
21*c* Leveling section
21*d* Groove section
21*e* Inner extension section

22*a* Latch
22*a*1 Through hole
22*b* Connection section

What is claimed is:

1. A container comprising:

a body member formed of a stacked film and having an upper opening end and a bottom;

a frame member that is so provided as to be joined with an outer circumferential surface of the upper opening end of the body member and reinforces an edge portion of the upper opening end in such a way that a predetermined opening shape of the upper opening end is maintained; and a plurality of container holders, each of which is provided in a position where a finger touches the body member when the body member is held and extends downward from the frame member toward the bottom of the body member, wherein the body member has a box-like shape, the frame member has a rectangle shape, the plurality of container holders are provided at corners of the frame member, and the plurality of container holders are provided so as to extend along a long side of the frame member to such an extent that the container holder receives a finger of a user when the user grabs the container with one hand by sandwiching a short side of the frame member, and wherein a length of the container holder is greater than a width of the container holder, and the width of the container holder is greater than a width of the frame member, and wherein the plurality of container holders are adhered to the body member.

2. The container according to claim 1, wherein the stacked film comprises a first heat seal layer that forms the outer circumferential surface of the body member and allows heat sealing, a second heat seal layer that forms an inner circumferential surface of the body member and allows heat sealing, and a base material layer provided between the first heat seal layer and the second heat seal layer.

3. The container according to claim 1, wherein the plurality of container holders are formed in a recessed shape extending along a shape of the finger that holds the body member.

4. The container according to claim 1, wherein the container further comprises a base frame fitted into the frame member and a lid member having a lid pivotably attached to the base frame.

* * * * *